US009499754B2

(12) United States Patent
Boe

(10) Patent No.: US 9,499,754 B2
(45) **Date of Patent: *Nov. 22, 2016**

(54) METHODS FOR CONVERTING MOTOR OIL INTO FUEL

(71) Applicant: OTG RESEARCH, LLC, Lone Tree, CO (US)

(72) Inventor: Philip Allen Boe, Lone Tree, CO (US)

(73) Assignee: OTG Research, LLC, Lone Tree, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/682,642

(22) Filed: Apr. 9, 2015

(65) Prior Publication Data

US 2016/0010009 A1 Jan. 14, 2016

Related U.S. Application Data

(63) Continuation of application No. 13/939,129, filed on Jul. 10, 2013, now Pat. No. 9,006,504, which is a continuation of application No. 13/445,738, filed on Apr. 12, 2012, now Pat. No. 8,492,601.

(60) Provisional application No. 61/474,502, filed on Apr. 12, 2011.

(51) Int. Cl.

| | |
|---|---|
| ***C10L 1/08*** | (2006.01) |
| ***C10G 53/00*** | (2006.01) |
| ***C10G 53/14*** | (2006.01) |

(Continued)

(52) U.S. Cl.

CPC ..... *C10L 1/08* (2013.01); *C10G 53/00* (2013.01); *C10G 53/14* (2013.01); *C10L 1/04* (2013.01); *C10M 175/0016* (2013.01);

(Continued)

(58) Field of Classification Search

None

See application file for complete search history.

(56) References Cited

U.S. PATENT DOCUMENTS

| | | | |
|---|---|---|---|
| 2,474,411 | A | 6/1949 | Bersworth et al. |
| 3,124,525 | A | 3/1964 | Remonte |

(Continued)

FOREIGN PATENT DOCUMENTS

| | | |
|---|---|---|
| EP | 0236021 | 9/1987 |
| JP | 2006249419 | 9/2006 |

(Continued)

OTHER PUBLICATIONS

Noureddini et al., "Kinetics of Transesterification of Soybean Oil," JAOCS, vol. 74, No. 11 (1997); p. 1458, col. 1, paragraph 3; p. 1458, col. 2., paragraph 2; Fig. 3); retrieved from http://journeytofoever.org/biofuel_library/kinetics.pdf on Mar. 6, 2013.

(Continued)

*Primary Examiner* — Tam M Nguyen

(74) *Attorney, Agent, or Firm* — Christopher P. Whitham; Cochran Freund & Young LLC

(57) ABSTRACT

Methods for converting motor oil into fuel generally include forming a conversion mixture of an alcohol and a base, and adding the conversion mixture to motor oil, to form a reaction mixture. The methods can also include adding a high nitrate compound and an amino acid to the reaction mixture and ozonizing the reaction mixture. The result of the methods can include a three phase system in which the bottom phase is asphalt oil, the middle phase is diesel fuel or jet fuel, and the top phase is sulfuric acid. The three phases can be separated to obtain the final diesel fuel or jet fuel product.

15 Claims, 2 Drawing Sheets

(51) Int. Cl.
*C10L 1/04* (2006.01)
*C10M 175/00* (2006.01)

(52) U.S. Cl.
CPC ..... *C10L 2270/026* (2013.01); *C10L 2270/04* (2013.01); *C10L 2290/06* (2013.01); *C10L 2290/24* (2013.01)

(56) References Cited

U.S. PATENT DOCUMENTS

| | | | | |
|---|---|---|---|---|
| 5,424,467 | A | 6/1995 | Bam et al. | |
| 6,364,917 | B1 * | 4/2002 | Matsumura | C10L 1/026 44/301 |
| 7,497,939 | B2 | 3/2009 | Matsumura et al. | |
| 8,492,601 | B1 * | 7/2013 | Boe | C10G 53/14 208/179 |
| 8,859,833 | B2 | 10/2014 | Boe | |
| 9,006,504 | B2 | 4/2015 | Boe | |
| 2001/0020344 | A1 | 9/2001 | Thompson et al. | |
| 2001/0042340 | A1 | 11/2001 | Tateno et al. | |
| 2003/0167681 | A1 * | 9/2003 | Delgado Puche | C10L 1/026 44/388 |
| 2007/0113467 | A1 | 5/2007 | Abou-Nemeh | |
| 2008/0171889 | A1 | 7/2008 | Chen et al. | |
| 2011/0306101 | A1 * | 12/2011 | De Crecy | C12P 7/6409 435/134 |
| 2013/0274530 | A1 * | 10/2013 | Boe | C10G 57/00 585/310 |

FOREIGN PATENT DOCUMENTS

| | | |
|---|---|---|
| SU | 1442537 | 12/1988 |
| WO | 9411471 | 5/1994 |
| WO | 2007068800 | 6/2007 |

OTHER PUBLICATIONS

International Search Report and Written Opinion in PCT Application Serial No. PCT/US13/21467, mailed Mar. 28, 2013.

Noureddini et al., "Densities of Vegetable Oils and Fatty Acids," University of Nebraska—Lincoln, Chemical and Biomolecular Engineering Research and Publications, Dec. 1, 1992.

International Search Report and Written Opinion in PCT Application Serial No. PCT/US13/026503, mailed Aug. 20, 2013.

Non-Final Office Action mailed Jan. 18, 2013 in U.S. Appl. No. 13/445,738, filed Apr. 12, 2012.

Non-Final Office Action mailed Jul. 15, 2014 in U.S. Appl. No. 13/939,129, filed Jul. 10, 2013.

Non-Final Office Action mailed Dec. 3, 2014 in U.S. Appl. No. 14/319,951, filed Jun. 30, 2014.

International Search Report and Written Opinion in PCT Application Serial No. PCT/US13/036503, mailed Mar. 28, 2013.

European Supplementary Search Report, mailed Aug. 28, 2015, in EP Application No. 13775645.8.

* cited by examiner

| | 700 N-m | | | | Max Torque | | | |
|---|---|---|---|---|---|---|---|---|
| | Baseline Diesel | Syn-Diesel | Baseline JP-8 | Syn Jet A | Baseline Diesel | Syn-Die- | Base-line | Syn Jet A |
| Fuel Flow (kg/hr) | 25.1 | 25.3 | 24.6 | 25.1 | 35.1 | 35.4 | 34.6 | 34.8 |
| Engine Speed (RPM) | 1700 | 1700 | 1700 | 1700 | 1700 | 1700 | 1700 | 1700 |
| Engine Load (Nm) | 710 | 714 | 699 | 709 | 999 | 1001 | 988 | 990 |
| Brake Power (kW) | 126 | 127 | 124 | 126 | 178 | 178 | 176 | 176 |
| BSFC (g/kW-hr) | 198.9 | 198.9 | 197.5 | 199.2 | 197.1 | 198.8 | 197.0 | 197.7 |
| <u>Emissions</u> | | | | | | | | |
| THC (ppm) | | | | | | | | |
| O2 (%) | 72.0 | 63.9 | 63.0 | 61.3 | 67.4 | 61.9 | 64.8 | 65.0 |
| CO2 (%) | 8.31 | 8.71 | 8.86 | 8.75 | 7.07 | 7.06 | 7.42 | 7.52 |
| CO (ppm) | 9.14 | 8.87 | 8.65 | 8.76 | 10.00 | 10.06 | 9.65 | 9.72 |
| NOx (ppm) | 167 | 149 | 114 | 114 | 209 | 227 | 165 | 179 |
| | 741 | 713 | 722 | 743 | 900 | 901 | 908 | 897 |
| <u>Brake Specific Emissions</u> | | | | | | | | |
| NOx (g/kw-hr) | | | | | | | | |
| CO (g/kw-hr) | 5.384 | 5.338 | 5.507 | 5.635 | 5.916 | 5.942 | 6.185 | 6.090 |
| HC (g/kw-hr) | 0.469 | 0.435 | 0.333 | 0.333 | 0.755 | 0.817 | 0.609 | 0.660 |
| CO2 (g/kw-hr) | 0.182 | 0.166 | 0.167 | 0.162 | 0.154 | 0.142 | 0.153 | 0.153 |
| | 635.0 | 634.9 | 630.6 | 636.1 | 628.9 | 634.4 | 628.8 | 631.0 |

FIGURE 2

METHODS FOR CONVERTING MOTOR OIL INTO FUEL

CROSS REFERENCE TO RELATED APPLICATIONS

This application is a continuation of U.S. non-provisional application Ser. No. 13/939,129, filed Jul. 10, 2013, now U.S. Pat. No. 9,006,504, entitled "Methods for Converting Motor Oil into Fuel," which application is a continuation of U.S. non-provisional application Ser. No. 13/445,738, filed Apr. 12, 2012, now U.S. Pat. No. 8,492,601, entitled "Methods for Converting Used Oil into Fuel," which was based upon and claims priority to U.S. provisional application Ser. No. 61/474,502, filed Apr. 12, 2011, all of which are specifically incorporated herein by reference for all that they disclose and teach.

BACKGROUND OF THE INVENTION

The re-use of used motor oil has traditionally been limited to the burning of used motor oil in factories or manufacturing plants as a means to generate heat and/or fire boilers. However, recent changes by the U.S. Environmental Protection Agency to the rules governing the burning of used motor oil have severely restricted this practice. As a result, much of the used motor oil previously burned now must be disposed of as waste or repurposed in some other way.

Some attempts have been made to convert the used motor oil into higher grade fuels. This typically includes attempts to "re-crack" the used motor oil in a refinery system or chemically change the oil by adding various reactants. Neither method has proven to be economically viable and/or produce sufficient amounts of higher grade fuels.

SUMMARY OF THE INVENTION

Disclosed are embodiments of a method for converting used motor oil into higher grade fuels, such as diesel fuel or jet fuel.

In some embodiments, a method of converting motor oil, such as used and/or new motor oil, into diesel fuel or jet fuel may comprise: mixing an alcohol and a base to form a conversion mixture, said base being a base suitable for weakening and/or breaking bonds in hydrocarbon chains of said motor oil and which cancels out acidic components of said motor oil: adding the conversion mixture to motor oil to form a reaction mixture; heating the reaction mixture to a temperature of between 200° F. and 400° F. for a period of at least 1 hour; mixing said conversion mixture and said motor oil of said reaction mixture during and/or after (i.e., during at least a portion of said period of at least 1 hour) said heating of said reaction mixture to said temperature between 200° F. and 400° F.; cooling the reaction mixture to a temperature less than 70° F., adding a high nitrate compound to the reaction mixture; a step-f adding an amino acid to the reaction mixture; ozonizing the reaction mixture; and separating the reaction mixture into a sulfuric acid phase, a diesel fuel or jet fuel phase, and an asphalt oil phase.

It is to be understood that the foregoing is a brief summary of various aspects of some disclosed embodiments. The scope of the disclosure need not therefore include all such aspects or address or solve all issues noted in the "Background of the Invention" section above. In addition, there are other aspects of the disclosed embodiments that will become apparent as the specification proceeds.

Thus, the foregoing and other features, utilities, and advantages of the subject matter described herein will be apparent from the following more particular description of certain embodiments as illustrated in the accompanying drawings. In this regard, it is therefore also to be understood that the scope of the invention is to be determined by the claims as issued and not by whether given subject includes any or all features or aspects noted in this "Summary of the Invention" section or addresses any issues noted in the "Background of the Invention" section.

BRIEF DESCRIPTION OF THE DRAWINGS

The preferred and other embodiments are disclosed in association with the accompanying drawings in which:

FIG. 2 is a chart summarizing the results of diesel engine testing carried out on diesel fuel and jet fuel produced by embodiments of methods described herein.

DETAILED DESCRIPTION OF THE EMBODIMENTS

Figure 1:
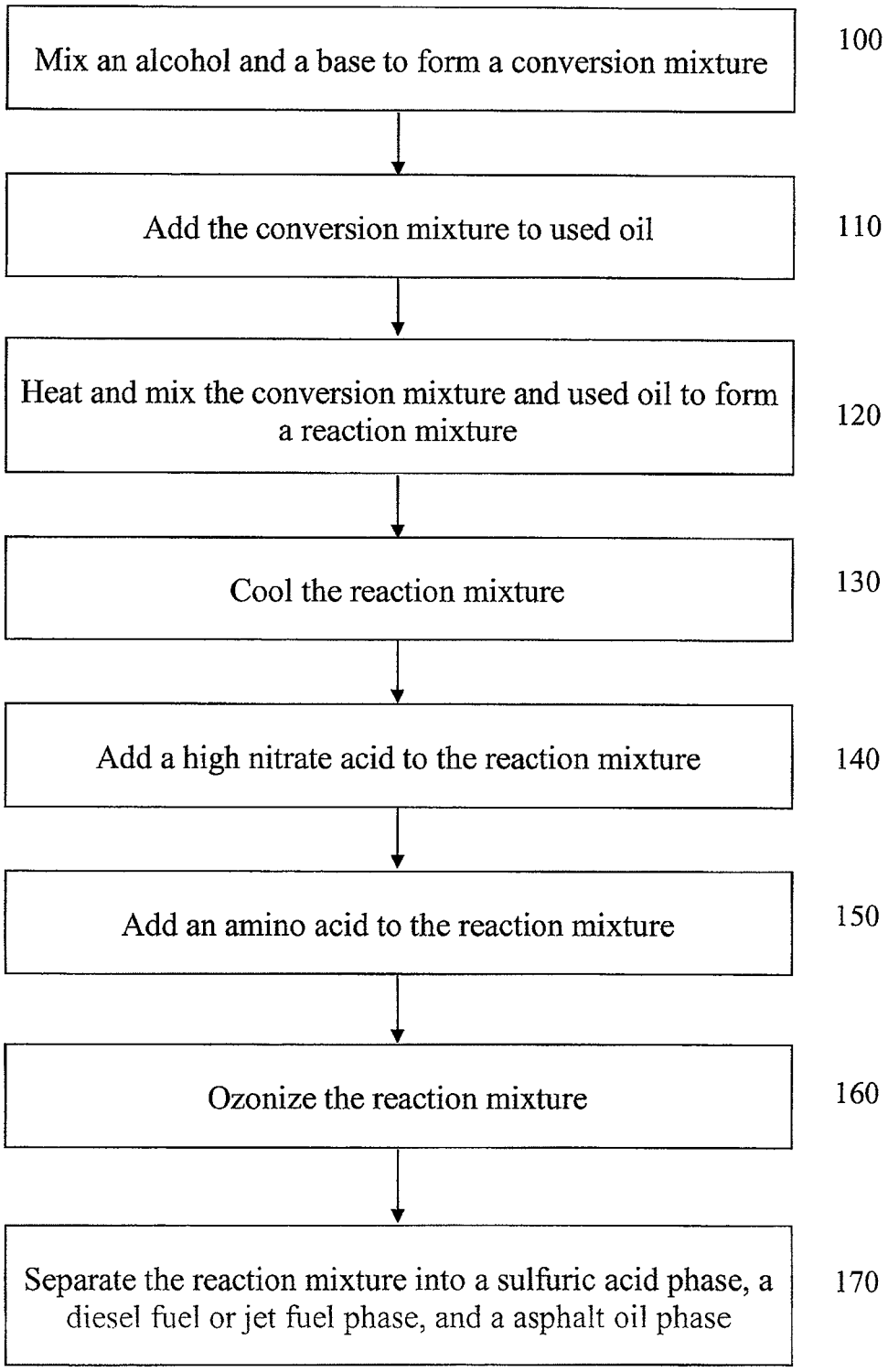
FIG. 1 is a flow chart detailing embodiments of a method for converting used oil into diesel fuel or jet fuel as disclosed herein.

With reference to FIG. 1, embodiments of a method for converting used oil into diesel fuel or jet fuel can include a step 100 of mixing an alcohol and a base to form a conversion mixture, a step 110 of adding the conversion mixture to used oil, a step 120 of heating and mixing the conversion mixture and used oil to form a reaction mixture, a step 130 of cooling the reaction mixture, a step 140 of adding a high nitrate compound to the reaction mixture, a step 150 of adding an amino acid to the reaction mixture, a step 160 of ozonizing the reaction mixture, and a step 170 of separating the reaction mixture into a sulfuric acid phase, a diesel fuel or jet fuel phase, and an asphalt oil phase.

In step 100, the conversion mixture is produced. Production of the conversion mixture generally includes mixing an alcohol and a base until the base is fully dissolved in the alcohol. Any method of mixing these two components can be used provided that the base fully dissolves in the alcohol. Similarly, any suitable mixing apparatus can be used for mixing the two components. Heat can be applied to the mixture during mixing as a means of promoting the dissolution of the base in the alcohol. If heat is added to promote dissolution, the conversion mixture should be allowed to cool back to room temperature before being added to the used oil in step 110.

The alcohol used in step 100 can generally include any alcohol suitable for serving as a carrier for the base and in which the base can be fully dissolved. In some embodiments, the alcohol is methanol, ethanol, t-butanol, isopropanol, or butanol, or any combination thereof. In some embodiments, the alcohol is mixed with benzene.

The base used in step 100 can generally include any base suitable for weakening and/or breaking the bonds in the hydrocarbon chains of the used oil and which cancels out acidic components of the used oil. In some embodiments, the base is soda ash, sodium carbonate, sodium hydroxide, baking soda, potassium hydroxide, or any combination thereof.

In some embodiments, the conversion mixture includes from 65 wt % to 90 wt % alcohol and from 10 wt % to 35 wt % base. In a preferred embodiment, the conversion mixture includes from 75 wt % to 85 wt % alcohol and from 15 wt % to 25 wt % base.

In some embodiments, the conversion mixture will be screened or filtered after the base has fully dissolved in the alcohol in order to remove any small particulates, such as metal filings, dried oil chunks, dirt, and miscellaneous deposits. Any method of screening or filtering can be used, and the screening or filtering will generally aim to remove any particulate having a size greater than 3 microns. The screening or filtering step is carried out before the conversion mixture is added to the used oil.

In step 110, the conversion mixture is added to used oil. Any manner of adding the conversion mixture to the used oil can be used, such as pouring the conversion mixture formed in a first mixing vessel into the used oil contained in a second vessel. The used oil to which the conversion mixture is added can generally include any type of used oil, but is preferably used motor oil. The used motor oil can be any grade of motor oil, including both single-grade and multi-grade motor oil. The used motor oil can also have any viscosity, as viscosity does not affect the products produced by the method described herein. The used motor oil can also include additives typically included in most motor oils, such as detergents, dispersants, corrosion inhibitors, and the like. The used motor oil can also be motor oil for any type of vehicle, including motor oil used in cars, motorcycles, buses, trucks, go-karts, snowmobiles, boats, lawn mowers, agricultural and construction equipment, locomotives, and aircraft. The used motor oil suitable for use in embodiments described herein has typically undergone thermal and mechanical degradation such that the motor oil has been removed from the engine in which it was previously used. The embodiments described herein can also be used on new motor oil.

In some embodiments, the used motor oil is filtered or screened prior to the conversion mixture being added to the used motor oil. Filtering or screening is aimed at removing solid particulate, such as coke particles or metallic particles. In some embodiments, the used oil is filtered to remove most or all particulate of 3 microns or larger. Any known filtering or screening equipment can be used to remove particulate from the used motor oil.

In some embodiments, the conversion mixture is added to the used oil such that the resulting mixture of conversion mixture and used oil is from about 20 wt % to 80 wt % used oil and from about 35 wt % to 65 wt % conversion mixture.

In step 120, the conversion mixture and the used oil are heated and mixed to form a reaction mixture. The mixing and heating of the used oil and the conversion mixture can take place in any vessel suitable for mixing and heating such components. In some embodiments, the vessel is a barrel having a heat source located underneath, inside of, and/or around the barrel and inside of which is a mixing device or into which a mixing device can be inserted. The mixing device is generally not limited, and can include, for example, a series of mixing paddles or blades that can be driven by an electrical motor or the like.

In some embodiments, the mixture of used oil and the conversion mixture is heated to a temperature in the range of from 200° F. and 400° F., and more preferably to a temperature in the range of from 225° F. to 250° F. Once heated to a temperature within this range, the temperature is maintained for a period of time of 1 hour or more, and preferably within a range of from 1 hour to 3 hours. Any manner of heating the used oil and reaction mixture can be used, such as through the use of a propane heating unit located under the vessel holding the used oil and reaction mixture. In some embodiments, the heating step drives off water and alcohol (from the conversion mixture).

The mixing of the used oil and the conversion mixture can take place during and/or after the desired temperature has been achieved. When mixing is carried out after the desired temperature has been achieved, the mixing can be carried out for the entire period of time during which the elevated temperature is maintained, for less than then the entire period of time during which the elevated temperature is maintained, or intermittently during the time the elevated temperature is maintained. In some embodiments, the mixing device used is operated in the range of from 30 to 40 RPM.

In step 130, the reaction mixture produced in step 120 is cooled. Any suitable manner for cooling the reaction mixture, including letting the reaction mixture cool at ambient temperature, can be used. In some embodiments, the reaction mixture is cooled to a temperature less than 70° F. The cooling of the reaction mixture can take place over any period of time necessary to cool the reaction mixture below 70° F. When ambient temperature is used to cool the reaction mixture, the cooling step can take 8 hours or longer. When the cooling of the reaction mixture is forced, such as through the use of cooling system, the time to bring the reaction mixture below 70° F. will be substantially shorter.

In step 140, a high nitrate compound is added to the reaction mixture. The high nitrate compound is any nitrate compound having a high degree of reactivity. Any high nitrate compound suitable for use in rebuilding the hydrocarbons that were broken down in previous steps can be used. In some embodiments, the high nitrate compound is ethyl ammonium nitrate, ammonium nitrate, potassium nitrate, sodium nitrate, nitric acid and methanol in combination, or tetranitratoxycarbon, or any combination thereof. Any manner of adding the high nitrate compound to the reaction can be used, such as pouring the high nitrate compound into the vessel holding the reaction mixture. Once the high nitrate compound is added to the reaction mixture, the reaction mixture can be stirred to promote a homogenous mixture of all of the components. Any suitable manner of mixing the reaction mixture can be used, including the use of the mixing mechanism previously used to mix the conversion mixture and the used oil.

In some embodiments, the amount of high nitrate compound added to the reaction mixture is such that the resulting mixture of high nitrate compound and reaction is from 60 wt % to 65 wt % reaction mixture and from 40 wt % to 45 wt % high nitrate compound.

In some embodiments, the high nitrate compound is added to an alcohol prior to being mixed with the reaction mixture. Any suitable alcohol can be used, with specific examples of alcohol/high nitrate compound pairs including ethanol and ammonium nitrate, ethanol and potassium nitrate, and ethanol and sodium nitrate. In some embodiments, the mixture of high nitrate compound and alcohol is from 70 wt % to 85 wt % high nitrate compound and from 15 wt % to 30 wt % alcohol.

The combination of the high nitrate compound and the reaction mixture leads to an exothermic reaction. In some embodiments, the mixture of high nitrate compound and reaction mixture should be allowed to stand for a set period of time to allow the reaction to run to completion. In some embodiments, the exothermic reaction can take place for an hour or longer. When the exothermic reaction raises the temperature of the reaction mixture, the reaction mixture can also be allowed to cool after the exothermic reaction is completed. In some embodiments, the reaction mixture is allowed to cool to less than 70° F. Any manner of allowing the reaction mixture to cool can be used, including ambient cooling or forced cooling through use of cooling system.

In step 150, an amino acid is added to the reaction mixture. Any specific amino acid can be used in step 150. In some embodiments, preferred amino acids include taurine or methionine. Any manner of adding the amino acid to the reaction can be used, such as pouring the amino acid into the vessel holding the reaction mixture. When the amino acid is added to the reaction mixture, the reaction mixture can be stirred to help promote formation of a homogenous mixture. Any suitable manner of mixing the reaction mixture can be used: including the use of the mixing mechanism previously used to mix the conversion mixture and the used oil.

The amount of amino acid added to the reaction mixture will generally control whether embodiments of the method described herein will convert the used oil into diesel fuel or jet fuel. When the used oil is to be converted to diesel fuel, the amount of amino acid added to the reaction mixture is such that the resulting mixture of amino acid and reaction is from 99.95 wt % to 99.99 wt % reaction mixture and from 0.01 wt % to 0.05 wt % amino acid. When the used oil is to be converted to jet fuel, the amount of amino acid added to the reaction mixture is such that the resulting mixture of amino acid and reaction is from 99.990 wt % to 99.999 wt % reaction mixture and from 0.001 wt % to 0.01 wt % amino.

In step 160, the reaction mixture is ozonized, which generally includes bubbling ozone gas through the reaction mixture. Ozonizing can be used to help remove and/or separate sulfur from the reaction mixture. Any apparatus capable of bubbling ozone through the reaction mixture can be used. The rate of ozone bubbled through the reaction mixture is generally not limited, and in some embodiments can be bubbled through the reaction mixture at a rate of from 1 gm/hr to 5 gm/hr. The ozonizing step can be carried out for a period of time ranging from about 6 hours to 30 hours or more, and more preferably in the range of from about range around 22 to 26 hours.

During and/or after the ozonizing step, the reaction mixture can be cooled. In some embodiments, the reaction mixture is cooled to a temperature of about 30° F.

Once the ozonizing step is completed, the reaction mixture can generally be left to settle and phase separate. In some embodiments, the reaction mixture can be left to settle for 24 hours or longer. Generally speaking, the reaction mixture when left to settle will settle into an asphalt oil phase at the bottom, a diesel or jet fuel phase in the middle, and a sulfuric acid phase at the top. The settled reaction mixture may also include extraneous material at the very bottom of the vessel.

Once the reaction mixture has been allowed to settle, a step 170 of separating the phases of the settled reaction mixture can be carried out. Any method of separating the phases of reaction mixture can be used, such as decanting or skimming. In some embodiments, the sulfuric acid is collected off the top of the settled reaction mixture, which may require careful and precision skimming. Once the sulfuric acid is removed, the fuel layer can be decanted or skimmed off of the asphalt oil layer at the bottom.

When embodiments of the method described herein are used to produce diesel fuel, the resulting diesel fuel has characteristics and qualities that compare favorably to diesel fuel produced through other methods, such as traditional refinery methods. For example, the normal alkane distribution of the diesel fuel compares favorably to the normal alkane distribution of traditionally produced diesel fuel. Diesel engine testing also confirms that the diesel fuel produced by the methods described herein compare favorably to diesel engine testing on traditionally manufactured diesel fuel. Further details of this testing is described below in the Examples.

Similar favorable results were obtained when comparing jet fuel produced by methods described herein to jet fuel produced by more traditionally refinery methods. Further details of this comparison are detailed below in the Examples.

In some embodiments, the method described herein must be performed sequentially. That is to say, each component must be added in the order laid out above. Deviation from the sequence of adding different components to the used oil can lead to less favorable results.

EXAMPLES

Example 1

A conversion mixture was formed by mixing together 43 ounces of methanol and 10 ounces of soda ash in a first vessel. The methanol and soda ash were mixed until the soda ash substantially dissolved in the methanol.

10 gallons of used motor oil was filtered to remove particulate 3 microns and larger. The filtered motor oil was then placed in a second vessel. The conversion mixture was poured into the second vessel holding the filtered used motor oil, and a propane beating unit located under the second vessel was ignited to begin the heating of the motor oil and the conversion mixture. The temperature of the used motor oil and conversion mixture was raised to 230° F. and maintained at this temperature for one hour. Mixing of the used oil and conversion mixture occurred periodically throughout the heating.

After 1 hour at 230° F., the mixture was allowed to cool at ambient temperature until the mixture reached a temperature of under 70° F. The cooling process took approximately 8 hours.

128 ounces of ethyl ammonium nitrate was poured into the second vessel, which resulted in an exothermic reaction taking place. The reaction was allowed to proceed for one hour. After 1 hour, the temperature of the mixture was taken, and the mixture was allowed to cool at ambient temperature until it again reached a temperature below 70° F.

14 ounces of taurine was added to the mixture, followed by bubbling ozone through the mixture using a spa ozone generator. The ozone was bubbled through the mixture for 24 hours.

After 24 hours, ozone bubbling was terminated and the mixture was allowed to settle for 24 hours. The mixture phase separated into predominantly three phases. The lowest phase was asphalt oil, the middle phase was diesel fuel, and the top phase was sulfuric acid. The sulfuric acid was collected off the top and set aside, followed by separating the diesel fuel from off the top of the asphalt oil phase.

Example 2

The same procedure as described in Example 1 was carried out, with the exception of adding 20 ounces of taurine. The phase separated mixture included a bottom phase of asphalt oil, a middle phase of jet fuel, and a top phase of sulfuric acid. The three phases were separated as described in Example 1.

Example 3

Diesel engine testing was conducted on the diesel and jet fuel phases collected in Examples 1 and 2. Performance and emissions of the two samples were tested and compared against performance and emissions tests on ultra low sulfur diesel (ULSD) and military grade JP-8. The tests were performed using a John Deere 6068H diesel engine operating at two different loads (nominally 700 N-m and 1000 N-m) at constant speed (1700 RPM). The John Deere engine was a 275 HP, 6.8 L, 6 cylinder, turbocharged, common-rail fuel injected diesel engine that meets EPA Tier 2 specification for off-road diesel engines.

At each of the two test conditions, fuel consumption was accurately measured using an AVL flow meter and exhaust gas measurements were made using a 5-gas emissions analysis system that includes chemiluminescence measurement of NO, $NO_2$ and total $NO_x$, flame ionization detection of total hydrocarbons and non-dispersive infrared detection of CO and $CO_2$. The results of these tests are shown in FIG. 2.

The results indicate that the engine operated normally using the Example 1 diesel fuel formulation (identified as Syn-Diesel in FIG. 2) and compared favorably with results of the engine operating on ULSD. Specifically, the brake specific fuel consumption (g/kw-hr), which is a measure of overall efficiency/fuel economy of the engine, was identical for the Example 1 diesel fuel and ULSD at the low load condition and increased by a nominal level of 0.8% at the high load condition. The latter increase is well within the experimental uncertainty. Similarly, the Example 2 jet fuel formulation (identified as Syn-Jet A in FIG. 2) performed comparably to JP-8 in the same engine in terms of brake specific fuel consumption.

The emissions results for both the Example 1 diesel fuel and Example 2 jet fuel were also comparable to that of ULSD and JP-8, respectively. Specifically, the Example 1 diesel fuel resulted in a decrease in brake specific $NO_x$ emissions ($g_{NOx}$/kw-hr) of 0.8% at the low condition and an increase of 0.4% at the high load condition in comparison to ULSD. The Example 1 diesel fuel resulted in a decrease in brake specific CO emissions ($g_{CO}$/kw-hr) of 7% at the low condition and an increase of 8% at the high load condition in comparison to ULSD. The Example 1 diesel fuel resulted in a decrease in brake specific unburned hydrocarbon emissions ($g_{HC}$/kw-hr) of 9% at the low condition and a decrease of 8% at the high load condition in comparison to ULSD.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

As used herein, spatial or directional terms, such as "left," "right," "front," "back," and the like, relate to the subject matter as it is shown in the drawing Figures. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as "have," "having," "include," and "including" should be construed to be synonymous with the terms "comprise" and "comprising."

Unless otherwise indicated, all numbers or expressions, such as those expressing dimensions, physical characteristics, etc., used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

In addition, all ranges disclosed herein are to be understood to encompass and provide support for claims that recite any and all sub-ranges or any and all individual values subsumed therein. For example, a stated range of 1 to 10 should be considered to include and provide support for claims that recite any and all sub-ranges or individual values that are between and/or inclusive of the minimum value of 1 and the maximum value of 10; that is, all sub-ranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A method for converting motor oil to diesel fuel or jet fuel, the method comprising:

mixing an alcohol and a base to form a conversion mixture, said base being a base suitable for weakening and/or breaking bonds in hydrocarbon chains of said motor oil and which cancels out acidic components of said motor oil;

adding said conversion mixture to said motor oil to form a reaction mixture;

heating said reaction mixture to a temperature of between 200° F. and 400° F. for a period of at least 1 hour;

mixing said conversion mixture and said motor oil of said reaction mixture during said heating of said reaction mixture to said temperature between 200° F. and 400° F.;

cooling said reaction mixture to a temperature less than 70° F.;

adding a high nitrate compound to said reaction mixture;

adding an amino acid to said reaction mixture;

ozonizing said reaction mixture; and separating said reaction mixture into sulfuric acid, diesel fuel or jet fuel, and asphalt oil.

2. The method of claim 1 wherein said motor oil is at least one of a group consisting of: used motor oil, and new motor oil.

3. The method of claim 1 wherein said alcohol is at least one of a group consisting of: an alcohol suitable for serving as a carrier for said base in which said base can be fully dissolved, methanol, ethanol, t-butanol, isopropanol, butanol, and an alcohol mixed with benzene.

4. The method of claim 1 wherein said base is at least one of a group consisting of: soda ash, sodium carbonate, sodium hydroxide, baking soda, and potassium hydroxide.

5. The method of claim 1 wherein said high nitrate compound is at least one of a group consisting of: a nitrate compound having a high degree of reactivity suitable for use in rebuilding hydrocarbons, ethyl ammonium nitrate, ammonium nitrate, potassium nitrate, sodium nitrate, nitric acid and methanol in combination, and tetranitratoxycarbon.

6. The method of claim 1 wherein said amino acid is at least one of a group consisting of: taurine and methionine.

7. The method of claim 1 wherein a mixing device used to perform said mixing of said conversion mixture and said motor oil of said reaction mixture is operated in a range of from 30 to 40 RPM.

8. A method for converting motor oil to diesel fuel or jet fuel, the method comprising:

mixing an alcohol and a base to form a conversion mixture, said base being a base suitable for weakening and/or breaking bonds in hydrocarbon chains of said motor oil and which cancels out acidic components of said motor oil;

adding said conversion mixture to said motor oil to form a reaction mixture;

heating said reaction mixture to a temperature of between 200° F. and 400° F. for a period of at least 1 hour;

mixing said conversion mixture and said motor oil of said reaction mixture after said heating of said reaction mixture to said temperature between 200° F. and 400° F. during at least a portion of said period of at least 1 hour;

cooling said reaction mixture to a temperature less than 70° F.;

adding a high nitrate compound to said reaction mixture;

adding an amino acid to said reaction mixture;

ozonizing said reaction mixture; and separating said reaction mixture into sulfuric acid, diesel fuel or jet fuel, and asphalt oil.

9. The method of claim 8 wherein said motor oil is at least one of a group consisting of: used motor oil, and new motor oil.

10. The method of claim 8 wherein said alcohol is at least one of a group consisting of: an alcohol suitable for serving as a carrier for said base in which said base can be fully dissolved, methanol, ethanol, t-butanol, isopropanol, butanol, and an alcohol mixed with benzene.

11. The method of claim 8 wherein said base is at least one of a group consisting of: soda ash, sodium carbonate, sodium hydroxide, baking soda, and potassium hydroxide.

12. The method of claim 8 wherein said high nitrate compound is at least one of a group consisting of: a nitrate compound having a high degree of reactivity suitable for use in rebuilding hydrocarbons, ethyl ammonium nitrate, ammonium nitrate, potassium nitrate, sodium nitrate, nitric acid and methanol in combination, and tetranitratoxycarbon.

13. The method of claim 8 wherein said amino acid is at least one of a group consisting of: taurine and methionine.

14. The method of claim 8 wherein said at least a portion of said period of at least 1 hour is one of a group consisting of: entire period of time during which the elevated temperature is maintained, for less than then the entire period of time during which the elevated temperature is maintained, or intermittently during the time the elevated temperature is maintained.

15. The method of claim 8 wherein a mixing device used to perform said mixing of said conversion mixture and said motor oil of said reaction mixture is operated in a range of from 30 to 40 RPM.

* * * * *